United States Patent [19]

Seki

[11] 4,156,322

[45] May 29, 1979

[54] SIMULATED TOY TYPEWRITER

[75] Inventor: Yoshizo Seki, Tokyo, Japan

[73] Assignee: Tomy Kogyo Co., Inc., Tokyo, Japan

[21] Appl. No.: 848,116

[22] Filed: Nov. 3, 1977

[30] Foreign Application Priority Data

Jun. 11, 1976 [JP] Japan ..... 51/149379[U]

[51] Int. Cl.[2] ..... A63H 33/30

[52] U.S. Cl. ..... 46/39; 46/175 R

[58] Field of Search ..... 46/39, 116, 175 R; 198/60, 197

[56] References Cited

U.S. PATENT DOCUMENTS 1,153,524 9/1915 Schwarzschild et al. ..... 46/116

3,479,918 11/1969 Genin ..... 46/175 R

FOREIGN PATENT DOCUMENTS 595859 4/1960 Canada.

*Primary Examiner*—Louis G. Mancene

*Assistant Examiner*—Robert F. Cutting

*Attorney, Agent, or Firm*—Edward D. O'Brian

[57] ABSTRACT

A simulated toy typewriter which is effective as a toy can be constructed utilizing a carriage movably mounted on a housing so as to be capable of being moved between the ends of a linear path. At least one simulated key or key element accessible from the exterior of the housing is pivotally mounted on the housing. Mechanical elements are used to cause advancement of the carriage from one end of the linear path toward the other an incremental amount each time a key element on the typewriter is actuated. The carriage contains a changeable exhibitor, a portion of which is visible through the exterior of the carriage. A mechanical structure is provided for actuating the changeable exhibitor so that a different portion of the exhibitor is visible from the exterior of the carriage each time the carriage is moved to adjacent to one end of the linear path.

10 Claims, 10 Drawing Figures

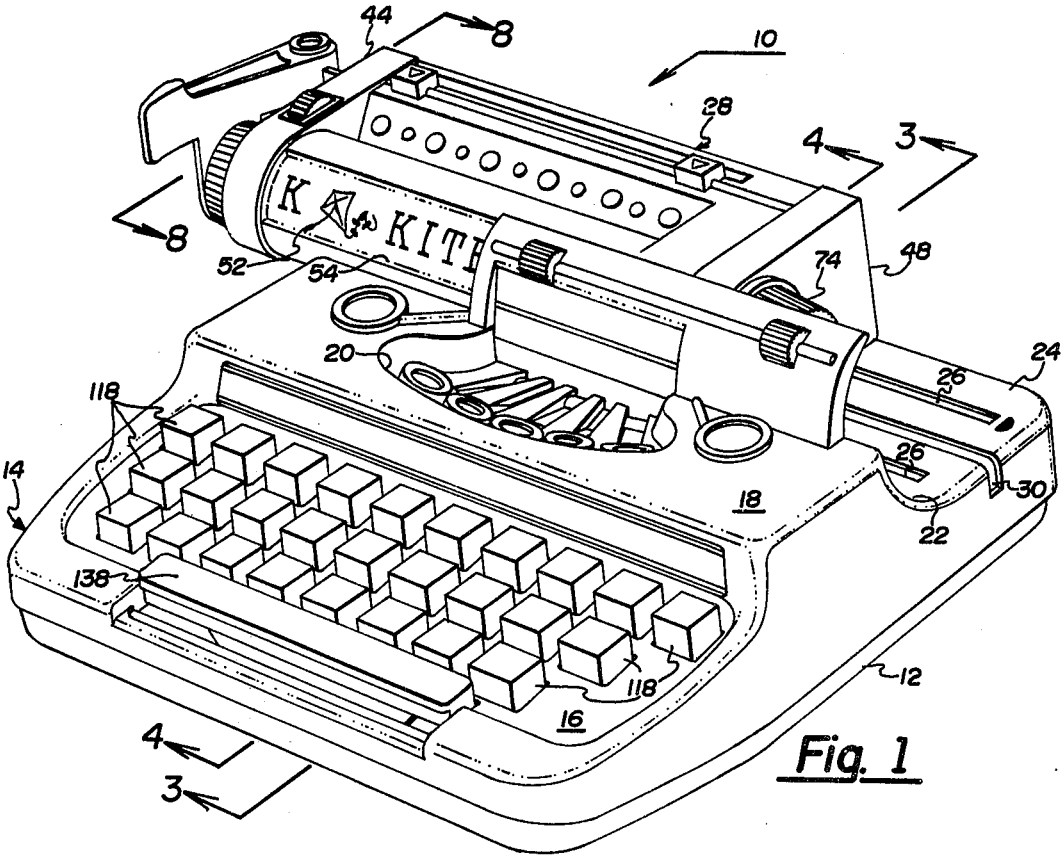
Fig. 1
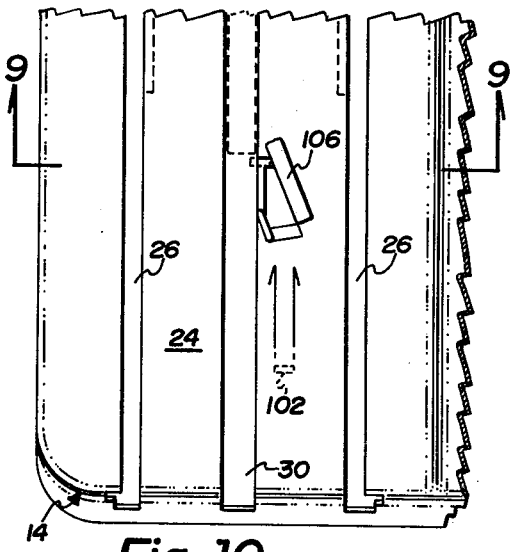
Fig. 10
Fig. 8
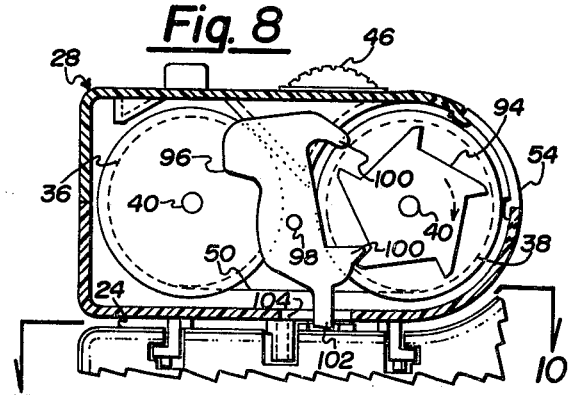
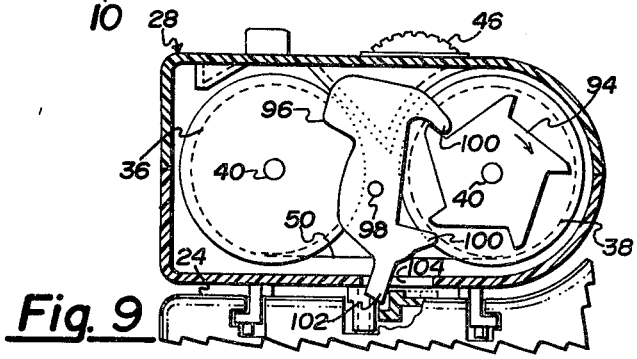
Fig. 9

SIMULATED TOY TYPEWRITER

BACKGROUND OF THE INVENTION

The invention set forth in this specification pertains to a new and improved simulated toy typewriter. More specifically it pertains to a toy typewriter which is particularly effective as a toy inasmuch as it incorporates typewriter simulating elements and a changeable exhibitor which is actuated as typewriter simulating elements are actuated.

It is not considered that an understanding of this invention requires a detailed consideration of various prior art conventional typewriters and simulated toy typewriters. It is well known that manual typewriters are normally constructed so as to include a housing carrying a movable carriage, various keys or key elements, and various typing or printing elements connected together so that each time a key or key element is actuated a typing or printing element is actuated and in turn the carriage is moved along a linear path a limited amount. It is conventional to connect such a carriage to the housing by a spring so that the carriage can be manually returned to one end of such a path and so that it can be advanced by the spring toward the other end of such a path as the typewriter is actuated in the manner briefly indicated.

The various simulated toy typewriters which have normally been constructed and sold in the past include various elements as are briefly indicated in the preceding discussion. These devices have proved to be effective toys. It is believed that the reasons for this are somewhat involved. To a degree the effectiveness of these toy typewriters as toys is considered to relate to the fact that such toys simulate reasonably well known conventional or adult type typewriters. It is considered that such toy simulated typewriters are also effective as toys because they are capable of being actuated by children so as to obtain a simple, immediate mechanical movement which tends to increase or heighten a child's interest.

In spite of the effectiveness of prior simulated toy typewriters as toys it is considered that there is a need for new and improved simulated toy typewriters. More specifically it is considered that there is a need for simulated toy typewriters which are of such a character as to accomplish an action corresponding to a degree to the printing normally achieved with a toy typewriter but which are of such a character as to avoid the various complications growing out of the use of printing elements within a typewriter. Also it is considered that there is a need for devices of the type indicated which are comparatively simple and effective, which can be manufactured at a comparatively nominal cost, and which are reasonably capable of withstanding the abuse normally given any toy by a child.

SUMMARY OF THE INVENTION

A broad objective of this invention is to provide new and improved simulated toy typewriters to fulfill the needs briefly indicated in the preceding discussion. Thus, the invention is intended to provide simulated toy typewriters which achieve an action reasonably corresponding to the printing action achieved with conventional adult or toy typewriters but which are of such a nature as to avoid the complication relating to the use of various printing type elements. Further objectives of the invention are to provide toy typewriters which are comparatively simple, which are quite effective for play purposes, which can be manufactured at a comparatively nominal cost, and which are capable of withstanding the abuse normally given a toy by a child.

In accordance with this invention the noted objectives and various other objectives as will be apparent from a consideration of this entire specification are achieved by providing a simulated toy typewriter having a housing, a carriage movably mounted on said housing so as to be capable of being moved between the ends of a linear path, a key means pivotally mounted in the housing so as to be accessible from the exterior of the housing, an advancing means operatively connecting said key means with said carriage for moving said carriage each time said key means is actuated in which the improvement comprises: changeable exhibitor means located on said carriage so that a portion of said changeable exhibitor means is visible from the exterior of said carriage and control means for actuating said changeable exhbitor means so that a different portion of said changeable exhibitor means is visible from the exterior of said carriage each time said carriage is moved.

A toy typewriter in accordance with this invention preferably includes a number of other features and details not specifically delineated in the preceding paragraph. Thus, for example, such a toy typewriter will normally be constructed so as to utilize a plurality of key means or key elements effectively simulating the typing keyboard on a conventional typewriter. The control means employed is preferably constructed so as to actuate the changeable exhibitor means each time the carriage means is moved adjacent to one of the ends of the linear path along which the carriage means is capable of being moved.

BRIEF DESCRIPTION OF THE DRAWINGS

Because of the nature of this invention it is considered that it is best more fully explained with reference to the accompanying drawings in which:

FIG. 1 is a perspective view of a presently preferred embodiment or form of a simulated toy typewriter in accordance with this invention;

FIG. 8 is a partial cross-sectional view taken at line 8—8 of FIG. 1;

FIG. 9 is a partial cross-sectional view corresponding to FIG. 8 illustrating the rotation of another escapement lever during the use of the toy typewriter illustrated;

FIG. 10 is a partial cross-sectional view taken at line 10—10 of FIG. 8.

Figure 2:
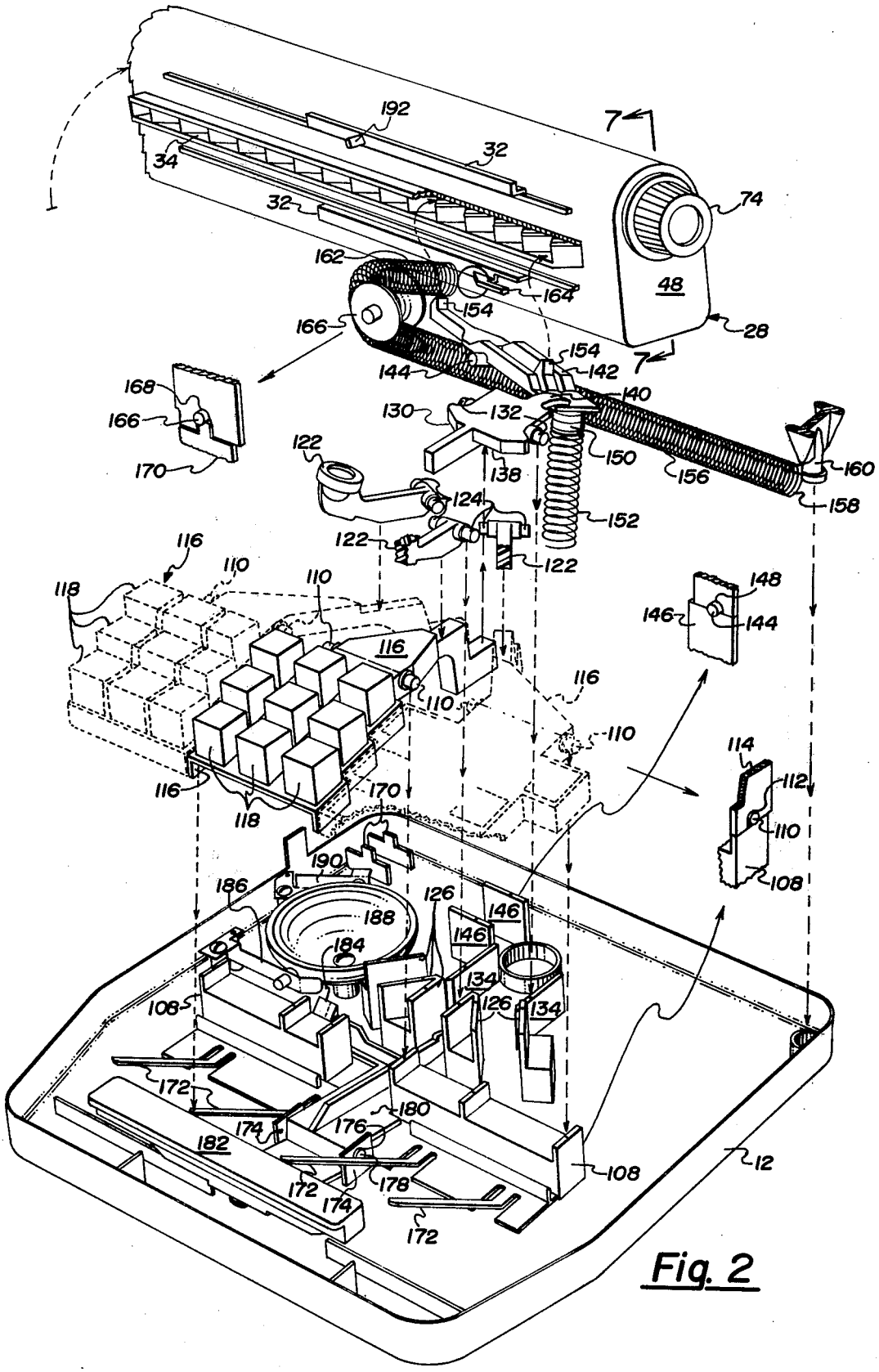
FIG. 2 is an exploded isometric view illustrating most of the parts employed in the typewriter illustrated in FIG. 1, certain of these parts being illustrated out of their normal orientation so as to facilitate an understanding of the invention.

The specific simulated toy typewriter illustrated in the drawings is constructed so as to utilize the operative concepts or principles defined in the appended claims forming a part of this specification. Those familiar with the mechanical aspects of the design of toys will realize that these concepts or principles can be easily utilized in a wide variety of somewhat differently constructed and somewhat differently appearing products. For this reason the present invention is not to be considered as being limited to the precise structure illustrated.

DETAILED DESCRIPTION

In the drawings there is shown a simulated toy typewriter 10 constructed so as to include a housing (not separately numbered) consisting of a base 12 and a cover 14 which fits on the base 12 so as to extend upwardly over it. The cover 14 is provided with a sloping top front surface 16 to a degree resembling a corresponding surface on a conventional typewriter (not shown). This cover 14 also includes a centrally located top wall 18 having a dished-out depression 20 corresponding to a depression in a conventional typewriter (not shown) which holds the typing elements of such a typewriter.

This top wall 18 is joined by a curved wall 22 to a flat wall 24 serving as a carriage support. This wall 24 is provided with two parallel elongated slots 26 which in effect serve as rails to hold and support the carriage 28 on the cover 14 in such a manner that the carriage 28 can be moved between the ends (not shown) of a linear path. The wall 24 also includes an elongated slot 30 located midway between the slots 26 for the purpose as hereinafter described.

The carriage 28 includes downwardly extending retainers 32 which fit the slots 26 and hold the carriage 28 relative to the cover 14 so that it cannot be moved generally away from the cover 14 although it is of course capable of being moved along a linear path as described in the preceding. This carriage 28 includes an elongated ratchet rack 34 which extends downwardly through the slot 30.

Within the carriage 28 there are located first and second parallel rollers 36 and 38, respectively. These rollers 36 and 38 are provided with mounting shafts 40 fitted within bearing-like shaft retainers 42 in the carriage 28. Two of these retainers 42 are not illustrated and are located upon an end cap 44 on the carriage 28. Two of these retainers 42 are located in a cross-wall 46 located adjacent to another end cap 48 on the carriage 28. These rollers 36 and 38 are both connected to a belt 50 containing various lines 52 of indicia, such as for example, lines of indicia indicating letters of the alphabet and words starting with such letters in such a manner that the belt 50 can be wound from either roller onto the other.

Each of the lines 52 corresponds in dimension to the dimensions of a window 54 located in the carriage 28 so as to be visible from the exterior of the typewriter 10. The shaft 40 secured to the roller 36 carries a small spur gear 56 which is adapted to mate with another spur gear 58 on a secondary shaft 60. This secondary shaft 60 is mounted in bearing openings 62 so as to extend generally inwardly from the end cap 48 to the cross-wall 46. A small coil spring 64 is located around the shaft 60 and is secured to a pin 66 extending from the gear 58. The spring 64 is also secured to a pin 68 extending from a ratchet wheel 70.

This ratchet wheel 70 is freely rotatable on the shaft 60. A resilient pawl 72 mounted within the carriage 28 engages the ratchet wheel 70 so as to prevent rotation of this ratchet wheel 70 relative to the shaft 60. The use of this pawl 72 and the ratchet wheel 70 is considered desirable in preloading or adjusting the energy or tension stored within the spring 64 so that this spring 64 can rotate the roller 36 in a desired manner.

This roller 36 is designed to be turned so as to store energy within the spring 64 through the use of a knob 74 located on the exterior of the carriage 28 adjacent to the end cap 48. This knob 74 is freely rotatable about the shaft 40 secured to the roller 38 and is biased toward the roller 38 through the use of a spring 76 mounted around this shaft 40. This spring 76 is held under compression against an interior wall 78 in the knob 74 through the use of a conventional retaining flange 80 secured to the noted shaft 40.

The purpose of this spring 76 is to establish pressure holding the faces (not separately numbered) of a ratchet type clutch 82 together so that this clutch 82 will transmit motion to the shaft 40 which extends from the roller 38. This shaft 40 jointly carries a toothed wheel 84 resembling a spur gear located adjacent to an elongated resilient arm 86 on a small lever 88. This lever 88 is mounted on the carriage 28 through the use of pivot pins 90 fitting within bearing-like retainers 92.

Figure 7:
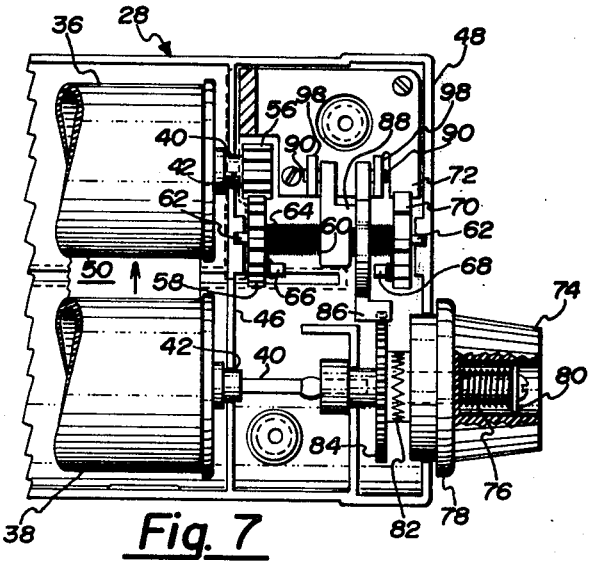
FIG. 7 is a partial cross-sectional view taken at line 7—7 of FIG. 2 showing internal details within the carriage employed in the illustrated toy typewriter.

This structure involving the arm 86 engaging the two wheels 84 is intended to provide a ratchet type sound when the knob 74 is rotated so that the wheel 84 engages the arm 86 so as to push it generally downwardly as viewed in FIG. 7. When this occurs the force applied to the arm 86 causes the lever 88 to engage the interior of the carriage 28 so as to block further rotation of this lever 88. During rotation of the shaft 40 attached to the roller 38 in the opposite direction the wheel 84 engages the arm 86 so as to pivot this arm 86 and the lever 88 generally away from the wheel 84. At the end of such movement the lever 88 and the arm 86 will fall into engagement with the wheel 84 through the action of gravity.

The shaft 40 extending through the roller 38 also carries a form of ratchet wheel 94 which is utilized in controlling the movement of the belt 50 from the roller 38 onto the roller 36. This ratchet wheel 94 is located adjacent to an escapement lever 96 mounted by means of a pivot 98 on the end cap 44. The escapement lever 96 includes the usual pawls 100 which are adapted to be moved relative to the wheel 94 in the usual manner so that at least one of these pawls 100 is always located so as to limit rotation of the roller 38.

A small projection 102 on the lever 96 extends downwardly from the carriage 28 through an opening 104 in the carriage 28. This projection 102 is located so that it will engage a sloping wall 106 on the wall 24 as the carriage 28 is moved in such a manner as to shift the position of the escapement lever 96 between the two positions shown in FIGS. 8 and 9. Such shifting of the escapement lever 96 will permit rotation of the roller 38 as a result of the action of the spring 64 rotating the roller 36. It is noted that the described structure permits the knob 74 to be rotated so as to wind the belt 50 onto the roller 38. As this occurs this spring 64 will be placed in a condition to tend to wind this belt 50 onto the roller 36. The clutch 82, of course, prevents damage from overwinding.

The significance of the structure generally within the carriage 28 is best explained with reference to the mechanism generally within the cover 14. The base 12 carries upstanding supports 108 which hold shafts 110 within notches 112 located on internal walls 114 within the cover 14. These shafts 110 are located on separate lever-like key elements 116. These key elements 116 are, as shown in FIG. 2, of a similar but not identical shape. Each of them includes a "bank" of projections 118 corresponding to a group of keys on a conventional typewriter keyboard. These projections 118 extend outwardly through openings 120 in the front surface 16 so as to appear like conventional typewriter keys.

The key elements 116 are essentially levers which are adapted to accomplish two different objectives. The first of these is to rotate upwardly a simulated typing element 122 as a key element 116 is engaged in the manner in which a conventional typewriter key is actuated. These typing elements 122 are constructed so as to each include shafts 124 which are held by supports 126 within bearing like notches 128 within the cover 14.

The key elements 116 are also adapted to pivot a control lever 130 each time there is engagement as indicated in the preceding. The control lever 130 also includes shafts 132 which are engaged by supports 134 in the base 12 so as to hold these shafts 132 within other notches 136 serving as bearings located within the cover 14. The control lever 130 is located so that one end 138 of it can be engaged by any of the key elements 116 so as to pivot this end 138 upwardly. Such rotation of the lever 130 causes downward movement of the other end 140 of this lever 130.

Such downward movement of the end 140 is utilized so as to cause rotation of an escapement lever 142. This escapement lever 142 also includes shafts 144 engaged by a support 146 on the base 12 so as to hold these shafts 144 within notches 148 formed within the cover 14. The escapement lever 142 includes a downwardly extending projection 150 serving as a retainer for an end (not separately numbered) of a small coil spring 152. This coil spring 152 is located between the lever 142 and the base 12 so as to tend to bias the lever 142 into engagement with the end 140 of the control lever 130.

The escapement lever 142 carries the usual two escapement pawls 154 in positions in which these pawls can engage the ratchet rack 34 on the carriage 28 in the usual manner in which escapement pawls engage a ratchet or ratchet rack. Thus, with this structure one of the pawls 154 is always located so as to engage the rack 34 so as to limit the amount that the carriage 28 may be moved at any one time. p This carriage 28 is adapted to be moved in one direction as far as it can travel through the use of an elongated coil spring 156. One end 158 of the spring 156 is connected to a projection 160 on the base 12. The other end 162 of the spring 156 is connected to a similar projection 164 on one of the retainers 34 on the carriage 28. The spring 156 travels around a roller 166 which is mounted in slots 168 within the cover 14 by means of supports 170.

With this construction when the carriage 28 is in the far left-hand position as shown in FIG. 1 the spring 156 can no longer move the carriage 28. When the carriage 28 is moved as far as it can travel toward the right as viewed in FIG. 1 the spring 156 is capable of moving the carriage 28 toward the left-hand position as such movement is permitted by the escapement lever 142 engaging the ratchet rack 34.

Figure 3:
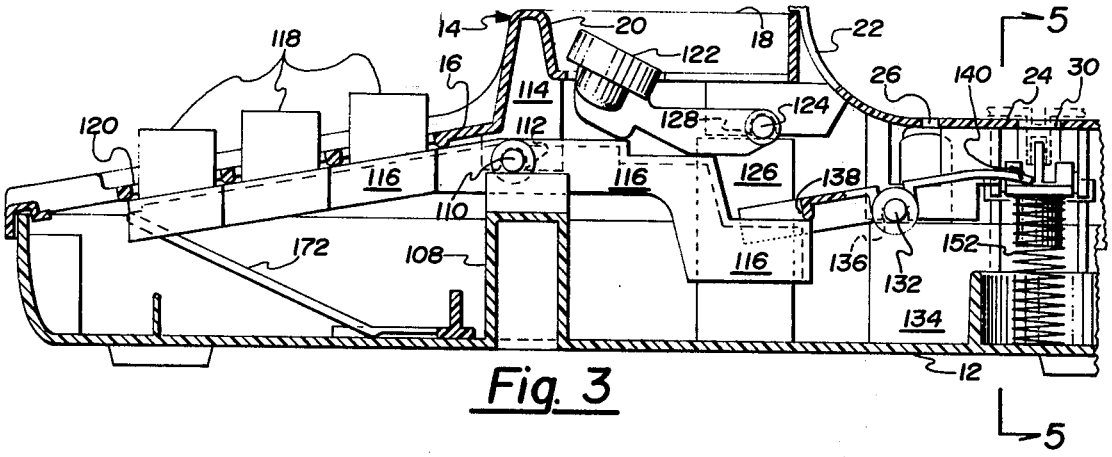
FIG. 3 is a cross-sectional view taken at line 3—3 of FIG. 1 in which certain parts have been omitted so as to facilitate an understanding of the illustrated parts.
Figure 4:
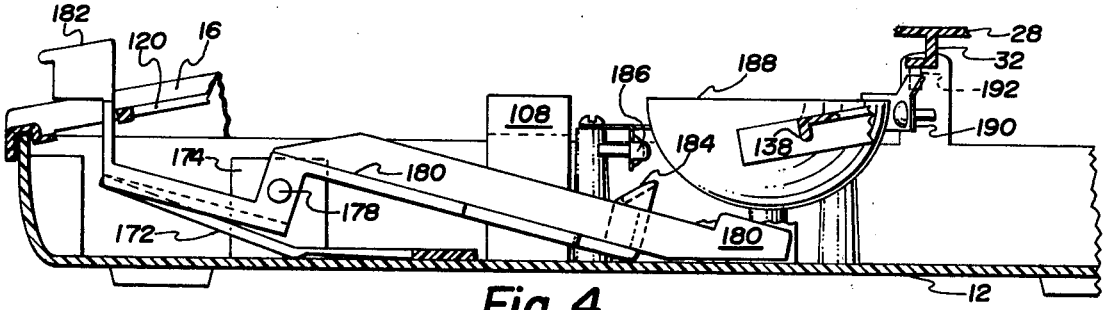
FIG. 4 is a partial cross-sectional view corresponding to a view taken at line 4—4 of FIG. 3 in which parts have been omitted so as to facilitate an understanding of the illustrated parts.
Figure 5:
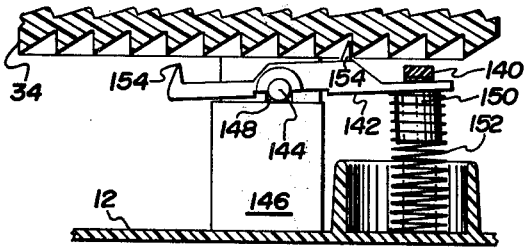
FIG. 5 is a partial cross-sectional view taken at line 5—5 of FIG. 3.
Figure 6:
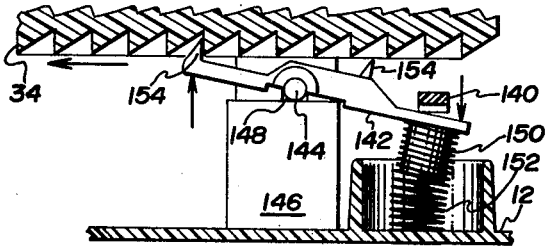
FIG. 6 is a view corresponding to FIG. 5 illustrating rotation of an escapement lever during the use of the illustrated toy typewriter.

From the preceding it will be apparent that each time a key element 116 is actuated from a normal position as indicated in FIGS. 1 and 3 of the drawings that the escapement lever 142 will be pivoted from the position as shown in FIG. 5 of the drawings to the position shown in FIG. 6 while concurrently a typing element 122 will be pivoted upwardly. Upon the subsequent release of a key element 116 the carriage 28 will be permitted to move an incremental amount corresponding to the spacing of the teeth (not separately numbered) of the rack 34. Upon such release the coil spring 152 will always tend to return the levers 130 and 142 to an initial position. Gravity will return the typing elements 122 to their initial positions. Elongated leaf-like springs 172 are mounted on the base 12 so as to engage the key elements 116 in such a manner as to bias them toward the desired initial position.

The base 12 also includes upstanding lugs 174 provided with bearing openings 176 which pivotally carry shafts 178 secured to a bell actuating lever 180. This lever 180 includes an elongated bar 182 corresponding to the space bar on a conventional manual typewriter. It also includes a projection 184 which is adapted to engage and then release a spring like striker arm 186 mounted on the base 12. Each time the arm 186 is engaged and then released such action will cause the arm 186 to move against a bell-like metal cup 188 mounted on the base 12. This will, of course, cause the production of a bell-like tone. If desired a similar striker arm 190 may be mounted on the base 12 in a position in which it will be engaged by a projection 192 located on one of the retainers 32.

When the toy typewriter 10 is to be utilized a child or other user is expected to initially turn the knob 74 so as to rotate the roller 38 in order to wind the belt 50 upon this roller 38. Such action will place the spring 64 in a condition such that it is capable of winding the belt 50 back on the roller 36. Also as the toy typewriter 10 is to be used the user is expected to move the carriage 28 to the far right-hand position referred to in the preceding discussion. This will place the spring 156 under tension so that this spring 156 is capable of returning the carriage 28 to the left-hand position as indicated in FIG. 1.

Thereafter as the key elements 116 are actuated the carriage 28 will move in an incremental manner toward this left-hand position. When it approaches this left-hand position the projection 102 will engage the wall 106 so as to rotate the escapement lever 96. This will permit the spring 64 to rotate the belt 50 so that a new line 52 can be viewed through the window 54. The escapement lever 96 will thereafter be returned to its initial position as the carriage 28 is moved back to the right-hand position as viewed in FIG. 1. Further, each time the carriage 28 returns toward the noted left-hand position the striker arm 190 will be actuated so as to produce a bell-like sound. Similarly at any time such a sound may be produced as a result of rotation of the lever 180.

In effect the described structure involves the incorporation within the toy typewriter 10 of a changeable exhibitor mechanism consisting of the various parts described in connection with the movement of the belt 50 relative to the window 54. In effect, the projections 102 and the sloping wall 106 cooperate with one another as a control means serving to actuate the changeable exhibitor mechanism each time the carriage 28 is returned to its left-hand position as the result of repeated operation of the key elements 116. By virtue of the interrelationship between the operation of these key elements 116 and the advancement of the belt 50 the toy typewriter 10 is considered to be a very effective toy. Its effectiveness is considered to be significant in view of various other features as indicated in the preceding discussion.

I claim:

1. A simulated toy typewriter having a housing, a carriage movably mounted on said housing so as to be capable of being moved between the ends of a linear path, a key means movably mounted in said housing so as to be accessible from the exterior of said housing, and advancing means operatively connecting said key means with said carriage for moving said carriage each time said key means is actuated, in which the improvement comprises:

changeable exhibitor means located on said carriage so that a portion of said changeable exhibitor means is visible from the exterior of said carriage, and control means for actuating said changeable exhibitor means so that a different portion of said changeable exhibitor means is visible from the exterior of said carriage each time said carriage is moved.

2. A simulated toy typewriter as claimed in claim 1 wherein:

said control means actuates said changeable exhibitor means each time said carriage means is moved adjacent to one of said ends.

3. A simulated toy typewriter as claimed in claim 1 wherein:

said carriage is hollow and includes a window visible from the exterior of said carriage, said portion of said changeable exhibitor means is visible through said window, said changeable exhibitor means includes a belt and roller means for supporting said belt so that said belt may be advanced past said window.

4. A simulated toy typewriter as claimed in claim 3 wherein:

said roller means comprises two parallel rollers, each of said rollers being rotatably mounted within said housing, said belt is located on said rollers so as to be capable of being wound from either of said rollers onto the other of said rollers, roller biasing spring means connected to one of said rollers for biasing said one of said rollers so as to wind said belt on said one of said rollers, escapement means for limiting the rotation of said one of said rollers so that a limited amount of said belt is wound around said one of said rollers at any time, and said control means includes coacting actuators on said housing and on said escapement means, said actuators engaging one another so as to cause actuation of said escapement means each time said carriage is moved adjacent to one of said ends after previously having been positioned away from said one of said ends.

5. A simulated toy typewriter as claimed in claim 4 wherein:

said changeable exhibitor means also includes manually operable means for winding said belt from said one of said rollers onto the other of said rollers, said manually operable means being operatively connected to said roller biasing spring means so as to place said roller biasing spring means in a condition to bias said one of said rollers so as to wind said belt on the same each time said manually operable means is operated so as to wind said belt from said one of said rollers onto the other of said rollers.

6. A simulated toy typewriter as claimed in claim 1 including:

advancing spring means for moving said carriage relative to said housing toward one of said ends of said linear path, said advancing spring means being connected to said carriage and to said housing, and wherein said advancing means includes a ratchet rack located on said carriage, said advancing means also includes an escapement means mounted on said housing, said escapement means being capable of being moved relative to said ratchet rack so as to permit incremental movement of said carriage means caused by said advancing spring means.

7. A simulated toy typewriter as claimed in claim 6 wherein:

said escapement means comprises a pivotally mounted escapement lever, said lever including two spaced pawl means, said escapement lever being capable of being pivoted between a first position in which one of said pawl means engages said rack and a second position in which the other of said pawl means engages said rack, at least one of said pawl means always being located so as to limit movement of said carriage.

8. A simulated toy typewriter as claimed in claim 7 wherein:

said key means is pivotally mounted on said housing, and including, mechanical means connecting said key means with said escapement lever so as to move the same relative to said rack each time said key means is actuated.

9. A simulated toy typewriter as claimed in claim 8 including:

positioning spring means for concurrently holding said key means in a position to be actuated and for holding one of said pawls in contact with said rack.

10. A simulated toy typewriter as claimed in claim 1 wherein:

said control means actuates said changeable exhibitor means each time said carriage means is moved adjacent to one of said ends, said carriage is hollow and includes a window visible from the exterior of said carriage, said portion of said changeable exhibitor means is visible through said window, said changeable exhibitor means includes a belt and roller means for supporting said belt so that said belt may be advanced past said window, said roller means comprises two parallel rollers, each of said rollers being rotatably mounted within said housing, said belt is located on said rollers so as to be capable of being wound from either of said rollers onto the other of said rollers, roller biasing spring means connected to one of said rollers for biasing said one of said rollers so as to wind said belt on said one of said rollers, escapement means for limiting the rotation of said one of said rollers so that a limited amount of said belt is wound around said one of said rollers at any time, said control means includes coacting actuators on said housing and on said escapement means, said actuators engaging one another so as to cause actuation of said escapement means each time said carriage is moved adjacent to one of said ends after previously having been positioned away from said one of said ends, said changeable exhibitor means also includes manually operable means for winding said belt from said one of said rollers onto the other of said rollers, said manually operable means being operatively connected to said roller biasing spring means so as to place said roller biasing means in a condition to bias said one of said rollers so as to wind said belt on the same each time said manually operable means is operated so as to wind said belt from said one of said rollers onto the other of said rollers, and including, advancing spring means for moving said carriage relative to said housing toward one of said ends of said linear path, said advancing spring means being connected to said carriage and to said housing, and wherein, said advancing means includes a ratchet rack located on said carriage, said advancing means also includes an escapement means mounted on said housing, said escapement means being capable of being moved relative to said ratchet rack so as to permit incremental movement of said carriage means caused by said advancing spring means, said escapement means comprises a pivotally mounted escapement lever, said lever including two spaced pawl means, said escapement lever being capable of being pivoted between a first position in which one of said pawl means engages said rack and a second position in which the other of said pawl means engages said rack, at least one of said pawl means always being located so as to limit movement of said carriage, said key means is pivotally mounted on said housing, and including, mechanical means connecting said key means with said escapement lever so as to move the same relative to said rack each time said key means is actuated, positioning spring means for concurrently holding said key means in a position to be actuated and for holding one of said pawls in contact with said rack.

* * * * *